US008733449B2

(12) United States Patent
Ehtesham et al.

(10) Patent No.: US 8,733,449 B2
(45) Date of Patent: May 27, 2014

(54) SELECTIVELY ACTIVATABLE AND DEACTIVATABLE WELLBORE PRESSURE ISOLATION DEVICE

(75) Inventors: Muhammad Asif Ehtesham, Spring, TX (US); Robert Lee Pipkin, Marlow, OK (US); Michael Brent Bailey, Duncan, OK (US)

(73) Assignee: Hilliburton Energy Services, Inc., Duncan, OK (US)

( * ) Notice: Subject to any disclaimer, the term of this patent is extended or adjusted under 35 U.S.C. 154(b) by 301 days.

(21) Appl. No.: 13/087,810

(22) Filed: Apr. 15, 2011

(65) Prior Publication Data

US 2012/0261136 A1 Oct. 18, 2012

(51) Int. Cl.
*E21B 34/06* (2006.01)

(52) U.S. Cl.
USPC ..... 166/373; 166/318; 137/613

(58) Field of Classification Search
USPC ..... 166/373, 374, 318, 325, 326, 332.1, 166/332.4, 332.8, 334.4; 137/613–614.21; 251/211, 298, 352
See application file for complete search history.

(56) References Cited

U.S. PATENT DOCUMENTS

| | | | | |
|---|---|---|---|---|
| 2,921,601 | A | 1/1960 | Fisher, Jr. | |
| 3,148,731 | A * | 9/1964 | Holden | 166/141 |
| 3,220,481 | A * | 11/1965 | Park | 166/193 |
| 3,481,397 | A * | 12/1969 | Baker | 166/320 |
| 3,799,258 | A | 3/1974 | Tausch | |
| 3,955,624 | A | 5/1976 | Fredd et al. | |
| 3,967,647 | A * | 7/1976 | Young | 137/614.11 |
| 4,058,165 | A | 11/1977 | Holden et al. | |
| 5,044,443 | A | 9/1991 | Churchman et al. | |
| 5,803,177 | A | 9/1998 | Hriscu et al. | |
| 5,819,853 | A * | 10/1998 | Patel | 166/373 |
| 6,158,516 | A | 12/2000 | Smith et al. | |
| 6,196,325 | B1 | 3/2001 | Connell et al. | |

(Continued)

FOREIGN PATENT DOCUMENTS

| | | |
|---|---|---|
| EP | 2108780 A1 | 10/2009 |
| GB | 2163795 A | 3/1986 |

(Continued)

OTHER PUBLICATIONS

Notice of Allowance dated Aug. 21, 2012 (5 pages), U.S. Appl. No. 12/713,256, filed Feb. 26, 2010.

(Continued)

*Primary Examiner* — Blake Michener
(74) *Attorney, Agent, or Firm* — John Wustenberg; Conley Rose, P.C.

(57) ABSTRACT

An apparatus comprising a tubular body defining a flowbore, a first valve that, when activated, restricts fluid communication via the flowbore in a first direction and allows fluid communication in a second direction, and, when deactivated, allows fluid communication in the first and second directions, a first sleeve slidable from a first to a second position that, when in the first position, the first valve is activated, and, when in the second position, the first valve is deactivated, a second valve, that, when activated, restricts fluid communication in the first direction and allows fluid communication in the second direction, and, when deactivated, allows fluid communication in the first and second directions, and a second sleeve slidable from a first to a second position, that, when in the first position, the second valve is deactivated, and, when in the second position, the second valve is activated.

23 Claims, 9 Drawing Sheets

(56) References Cited

U.S. PATENT DOCUMENTS

| | | | | |
|---|---|---|---|---|
| 6,253,842 | B1 | 7/2001 | Connell et al. | |
| 6,305,467 | B1 | 10/2001 | Connell et al. | |
| 6,390,199 | B1 | 5/2002 | Heijnen | |
| 6,401,824 | B1 * | 6/2002 | Musselwhite et al. | 166/327 |
| 6,508,309 | B1 * | 1/2003 | French | 166/323 |
| 6,688,389 | B2 | 2/2004 | Connell et al. | |
| 6,712,145 | B2 * | 3/2004 | Allamon | 166/327 |
| 6,808,023 | B2 | 10/2004 | Smith et al. | |
| 6,877,558 | B2 | 4/2005 | Connell et al. | |
| 7,134,488 | B2 | 11/2006 | Tudor et al. | |
| 7,168,492 | B2 * | 1/2007 | Laplante et al. | 166/319 |
| 7,246,668 | B2 | 7/2007 | Smith | |
| 7,337,852 | B2 | 3/2008 | Manke et al. | |
| 7,405,998 | B2 | 7/2008 | Webb et al. | |
| 7,648,179 | B2 | 1/2010 | Webb et al. | |
| 7,678,744 | B2 | 3/2010 | Abney et al. | |
| 7,832,482 | B2 | 11/2010 | Cavender et al. | |
| 7,866,400 | B2 | 1/2011 | Steele et al. | |
| 7,963,342 | B2 | 6/2011 | George | |
| 8,267,172 | B2 | 9/2012 | Surjaatmadja et al. | |
| 8,276,676 | B2 | 10/2012 | Hriscu et al. | |
| 2002/0033262 | A1 * | 3/2002 | Musselwhite et al. | 166/285 |
| 2003/0127227 | A1 * | 7/2003 | Fehr et al. | 166/306 |
| 2010/0181079 | A1 | 7/2010 | Johnson et al. | |
| 2011/0030968 | A1 * | 2/2011 | Xu | 166/373 |
| 2011/0073295 | A1 | 3/2011 | Steele et al. | |
| 2012/0097396 | A1 | 4/2012 | Stewart et al. | |

FOREIGN PATENT DOCUMENTS

| | | | |
|---|---|---|---|
| WO | 9919602 | A2 | 4/1999 |
| WO | 2011104516 | A2 | 9/2011 |
| WO | 2011104516 | A3 | 9/2011 |
| WO | 2011104516 | A8 | 9/2011 |

OTHER PUBLICATIONS

Foreign communication from a related counterpart application—International Preliminary Report on Patentability, PCT/GB2011/000265, Aug. 28, 2012, 7 pages.

Filing receipt and specification for patent application entitled "Well Intervention Pressure Control Valve," by Takao Stewart, et al., filed Jan. 18, 2013 as U.S. Appl. No. 13/745,116.

Patent application entitled "Pressure-activated valve for hybrid coiled tubing jointed tubing tool string," by Iosif Joseph Hriscu, et al., filed Feb. 26, 2010 as U.S. Appl. No. 12/713,256.

Foreign communication from a related counterpart application—International Search Report and Written Opinion, PCT/GB2011/000265, Mar. 26, 2012, 11 pages.

Office Action dated Mar. 29, 2012 (14 pages), U.S. Appl. No. 12/713,256, filed Feb. 26, 2010.

* cited by examiner

SELECTIVELY ACTIVATABLE AND DEACTIVATABLE WELLBORE PRESSURE ISOLATION DEVICE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Hydrocarbon-producing wells often are serviced by a variety of operations involving introducing a servicing fluid into a portion of a subterranean formation penetrated by a wellbore. Examples of such servicing operations include a fracturing operation, a hydra-jetting operation, a perforating operation, an acidizing operation, or the like. Such servicing operations may comprise the steps of positioning a work string within a wellbore penetrating the subterranean formation to be serviced and removing the work string from the wellbore after an operation or a portion of an operation has been completed.

Placement of the work string within the wellbore, often referred to as a "trip-in" or "run-in," requires breaking and making multiple connections to the work string as the work string is lowered in the wellbore. For example, where the work string comprises jointed tubing, additional segments or tubing "joints" are incorporated within the working at the uppermost end of the work string as it is lowered into the wellbore. Therefore, each time an additional joint is to be added to the work string, the connection to the work string must be "broken" or disconnected such that the joint to be added may be inserted into the work string.

Similarly, removal of the work string from within the wellbore, often referred to as a "trip-out" or "run-out," also requires breaking and making multiple connections to the work string as the work string is pulled out of the wellbore. For example, where the work string comprises jointed tubing, tubing joints incorporated within the work string are removed therefrom as the work string is pulled out of the wellbore. Therefore, each time a joint is to be removed from the work string, the connection to the work string must be broken and remade. Similarly, connections to a work string must be broken and made when using various other tubing configurations (e.g., coiled tubing).

Therefore, in either a trip-in or a trip-out, breaking a connection in the work string opens the work string and, because the work sting at least partially penetrates a wellbore which may be "live" (i.e., the wellbore may be under pressure), breaking the connection to the work string presents the possibility of backflow through the work string if the pressure within the work string is not isolated. Failure to isolate the wellbore pressure may allow fluid to escape from the work string presenting numerous complications including, among others, danger to workers, losses of time, and potential damage to equipment, and necessitating clean-up efforts.

Prior efforts to isolate the pressure of a work string have sometimes proven unreliable and, thus possibly unsafe. In addition, prior efforts to isolate the pressure within a work string have sometimes not allowed the operator the ability to isolate well pressure during trip-in, reverse-flow servicing fluids during a servicing operation, and isolate well pressure again during trip-out. Thus, there is a need for an improved means of isolating wellbore pressure.

SUMMARY OF THE INVENTION

Disclosed herein is a wellbore servicing apparatus comprising a tubular body at least partially defining an axial flowbore, a first valve assembly, positioned within the tubular body, wherein, when activated, the first valve assembly will restrict fluid communication via the axial flowbore in a first direction and allow fluid communication in a second direction, and, when deactivated, the first valve assembly will allow fluid communication via the axial flowbore in the first direction and the second direction, a first sliding sleeve slidable within the tubular body and transitionable from a first position to a second position, wherein, when the first sliding sleeve is in the first position, the first valve is in the activated mode, and, when the first sliding sleeve is in the second position, the first valve is retained in the deactivated mode, a second valve assembly, positioned within the tubular body downhole from the first valve assembly, wherein, when activated, the second valve assembly will restrict fluid communication via the axial flowbore in the first direction and allow fluid communication in the second direction, and, when deactivated, the second valve assembly will allow fluid communication via the axial flowbore in the first direction and the second direction, and a second sliding sleeve slidable within the tubular body and transitionable from a first position to a second position, wherein, when the second sliding sleeve is in the first position, the second valve is retained in the deactivated mode, and, when the first sliding sleeve is in the second position downhole from the first position, the second valve is in the activated mode.

Also disclosed herein is a wellbore servicing apparatus comprising an axial flowbore, the wellbore servicing apparatus being transitionable from a first mode to a second mode and transitionable from the second mode to a third mode, wherein, when the wellbore servicing apparatus is in the first mode, reverse-circulation via the axial flowbore is restricted and forward-circulation via the axial flowbore is allowed, when the wellbore servicing apparatus is in the second mode, forward-circulation and reverse-circulation via the axial flowbore is allowed, and when the wellbore servicing apparatus is in the third mode, reverse-circulation via the axial flowbore is restricted.

Further disclosed herein is a wellbore servicing method comprising positioning a wellbore servicing apparatus comprising an axial flowbore within a wellbore in a first mode, wherein, when the wellbore servicing apparatus is in the first mode, reverse-circulation via the axial flowbore is restricted and forward-circulation via the axial flowbore is allowed, transitioning the wellbore servicing apparatus from the first mode to a second mode, wherein, when the wellbore servicing apparatus is in the second mode, forward-circulation and/or reverse-circulation via the axial flowbore is allowed, and transitioning the wellbore servicing apparatus from the second mode to a third mode, wherein, when the wellbore servicing apparatus is in the third mode, reverse-circulation via the axial flowbore is restricted.

Further disclosed herein is a wellbore servicing apparatus comprising a tubular body at least partially defining an axial flowbore, a valve assembly, positioned within the tubular body, wherein, when activated, the valve assembly will restrict fluid communication via the axial flowbore in a first direction and allow fluid communication in a second direction, and, when deactivated, the valve assembly will allow fluid communication via the axial flowbore in the first direction and the second direction, and a sliding sleeve slidable within the tubular body and transitionable from a first position to a second position, wherein, when the sliding sleeve is in the first position, the second valve is retained in the deactivated mode.

Further disclosed herein is a wellbore servicing method comprising positioning a wellbore servicing apparatus comprising an axial flowbore within a wellbore in a first mode, wherein, when the wellbore servicing apparatus is in the first mode, forward-circulation and/or reverse-circulation via the axial flowbore is allowed, and transitioning the wellbore servicing apparatus from the first mode to a second mode, wherein, when the wellbore servicing apparatus is in the second mode, reverse-circulation via the axial flowbore is restricted.

DETAILED DESCRIPTION

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are one or more embodiments of a selectively activatable and deactivatable wellbore pressure-isolation device (WID). In one or more of the embodiments disclosed herein, such a WID may be employed in the performance of a wellbore servicing operation such as, but not limited to, a fracturing operation, a hydra-jetting operation, an acidizing operation, a clean-out operation, a plug mill-out operation, a multi-zone stimulation, a multi-zone matrix treatment, a gravel packing operation, a window-cutting operation, a conformance operation, a screen repair operation, a fishing operation, a well control operation, or combinations thereof.

Figure 1:
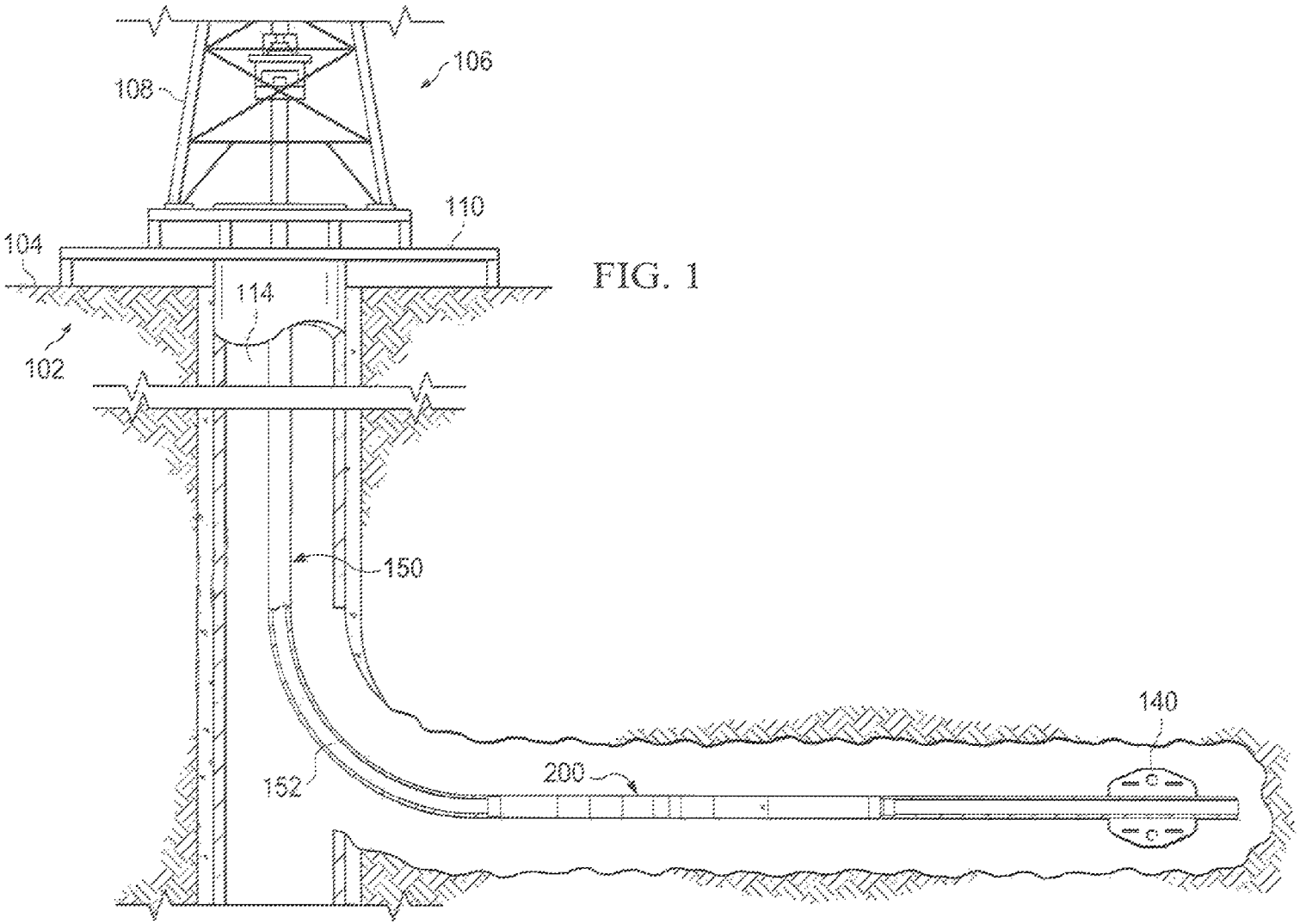
FIG. 1 is a cut-away illustration of an environment for a wellbore servicing operation.

Referring to FIG. 1, an embodiment of an operating environment in which a WID may be employed is illustrated. It is noted that although some of the figures may exemplify horizontal or vertical wellbores, the principles of the devices, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which a work string 150 (e.g., a drill string, a tool string, a segmented tubing string, a coiled tubing string, a jointed tubing string, an injection string, a production string, or any other suitable conveyance, or combinations thereof) may be positioned within or partially within the wellbore 114.

The drilling or servicing rig may be conventional and may comprise a motor driven winch and other associated equipment for lowering the work string 150 into the wellbore 114. Alternatively, a mobile workover rig, a wellbore servicing unit (e.g., coiled tubing units), or the like may be used to lower the work string 150 into the wellbore 114. In an embodiment, the work string 150 is configured for the introduction and production of fluids to or from the formation, such as, an injection and/or production string.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, the work string 150 may comprise two or more concentrically positioned strings of pipe or tubing (e.g., a first work string may be positioned within a second work string).

In the embodiment of FIG. 1, at least one WID 200, for example, of the type as will be disclosed herein, is integrated and/or incorporated within the work string 150. Additionally, at least one wellbore servicing apparatus 140 configured for the performance of one or more wellbore servicing operations may be integrated within the work string 150. The wellbore servicing apparatus 140 may be configured to perform a given servicing operation, for example, fracturing the formation 102, expanding or extending a fluid path through or into the subterranean formation 102, producing hydrocarbons from the formation 102, or combinations thereof. In an embodiment, the wellbore servicing apparatus 140 may comprise one or more ports, apertures, nozzles, jets, windows, or combinations thereof for the communication of fluid from a flowpath within the work string 150 to the subterranean formation 102. Additional down-hole tools may be included with or integrated within the wellbore servicing apparatus 140 and/or the work string 150 for example, one or more isolation devices, for example, packers such as swellable packers or mechanical packers.

It is noted that although some of the figures may exemplify a given operating environment, the principles of the devices, systems, and methods disclosed may be similarly applicable in other operational environments, such as offshore and/or subsea wellbore applications.

In an embodiment, the WID disclosed herein may be employed in the performance of a servicing operation for the purpose of selectively isolating wellbore pressure. For example, in an embodiment as will be described herein, the WID 200 disclosed herein may be selectively configurable for one of at least three modes. In an embodiment, the WID 200 may be configured in a first or "trip-in," mode, a second or "operational" mode, and a third or "trip-out" mode. In an embodiment, when the WID 200 is configured in the first or trip-in mode, the WID 200 may permit or allow fluid flow via the work string 150 in one direction and restrict or disallow fluid flow via the work string 150 in the opposite direction. Particularly, in the trip-in mode, the WID 200 may allow downward or down-hole fluid flow (referred to as forward-circulation) and restrict upward or up-hole fluid flow (referred to as reverse-circulation or back-flow). In an embodiment, when the WID 200 is configured in the second or operational mode, the WID 200 may permit or allow fluid flow via the work string 150 in both directions. That is, in the operational mode, the WID 200 may allow both forward-circulation and reverse-circulation of a fluid. In an embodiment, when the WID 200 is configured in the third or trip-out mode, the WID 200 may restrict or disallow fluid flow via the work string 150 in the at least one direction. Particularly, in the trip-out mode, the WID may restrict reverse-circulation of a fluid. In an embodiment, the WID may be selectively transitionable from the trip-in mode to the operational mode and selectively transitionable from the operational mode to the trip-out mode.

In one or more of the embodiments disclosed herein, a WID such as WID 200 may be discussed with reference to one or more figures. In these figures, the illustrated embodiments of the WID are generally oriented such that the upper-most (i.e., the furthest up-hole) end or portion of the WID 200 may be toward the left-hand side of such figure while the lower-most (i.e., the further down-hole) end or portion of the WID 200 may be toward the right-hand side of the figure. It is noted that reference herein to an upper, upper-most, up-hole, lower, lower-most, or down-hole, portion, segment, and/or component should not be construed as so-limiting unless otherwise specified. While the embodiments of a WID may be illustrated in a given configuration or orientation, one of skill in the art with the aid of this disclosure will appreciate that a WID may be suitably otherwise configured or oriented.

Figure 2A:
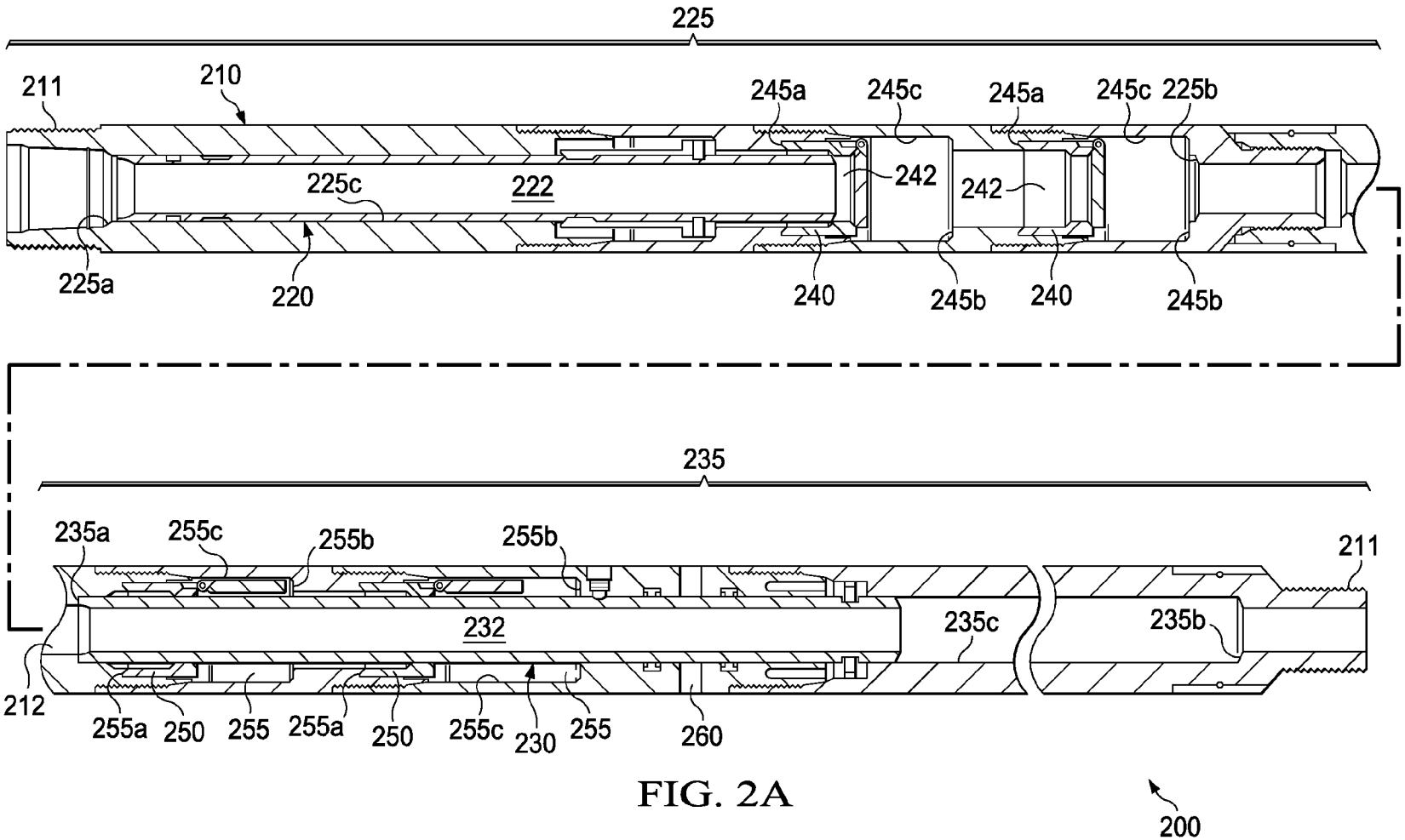
FIG. 2A is a cut-away illustration of a wellbore isolation device shown in a trip-in configuration.

Referring to FIG. 2A, an embodiment of the WID 200 is illustrated in a trip-in mode. The WID 200 generally comprises a tubular body 210, a first sliding sleeve 220, a second sliding sleeve 230, a first valve assembly 240, and a second valve assembly 250. In an embodiment, the first valve assembly 240 and/or the second valve assembly 250 may be present within a WID in duplicate, triplicate, or more. For example, in one or more of the embodiments illustrated herein, the first valve assembly 240, the second valve assembly 250, and associated component (e.g., recesses) are shown in duplicate, however, the present disclosure should not be construed as so-limited.

Figure 2B:
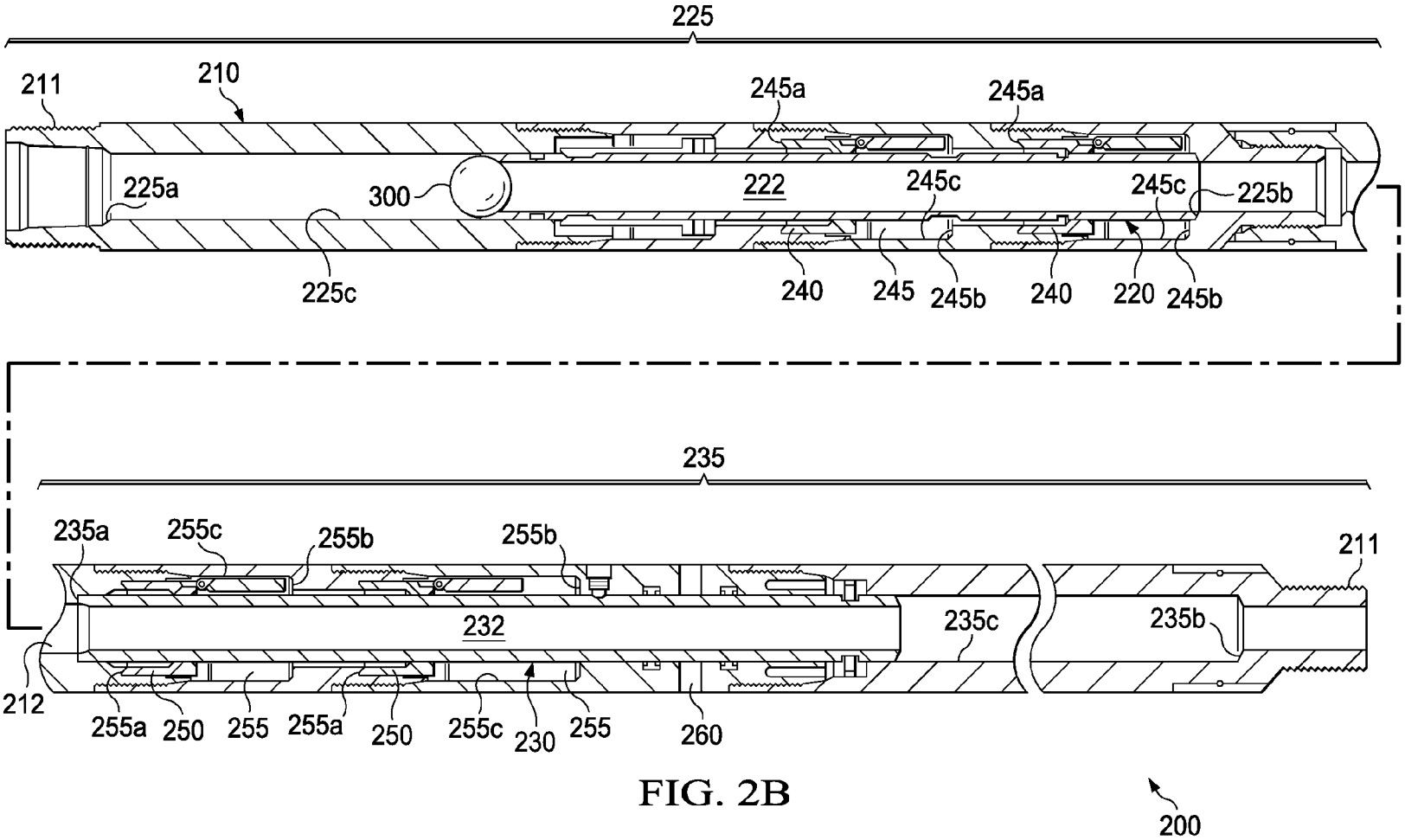
FIG. 2B is a cut-away illustration of a wellbore isolation device shown in an operational configuration.
Figure 2C:
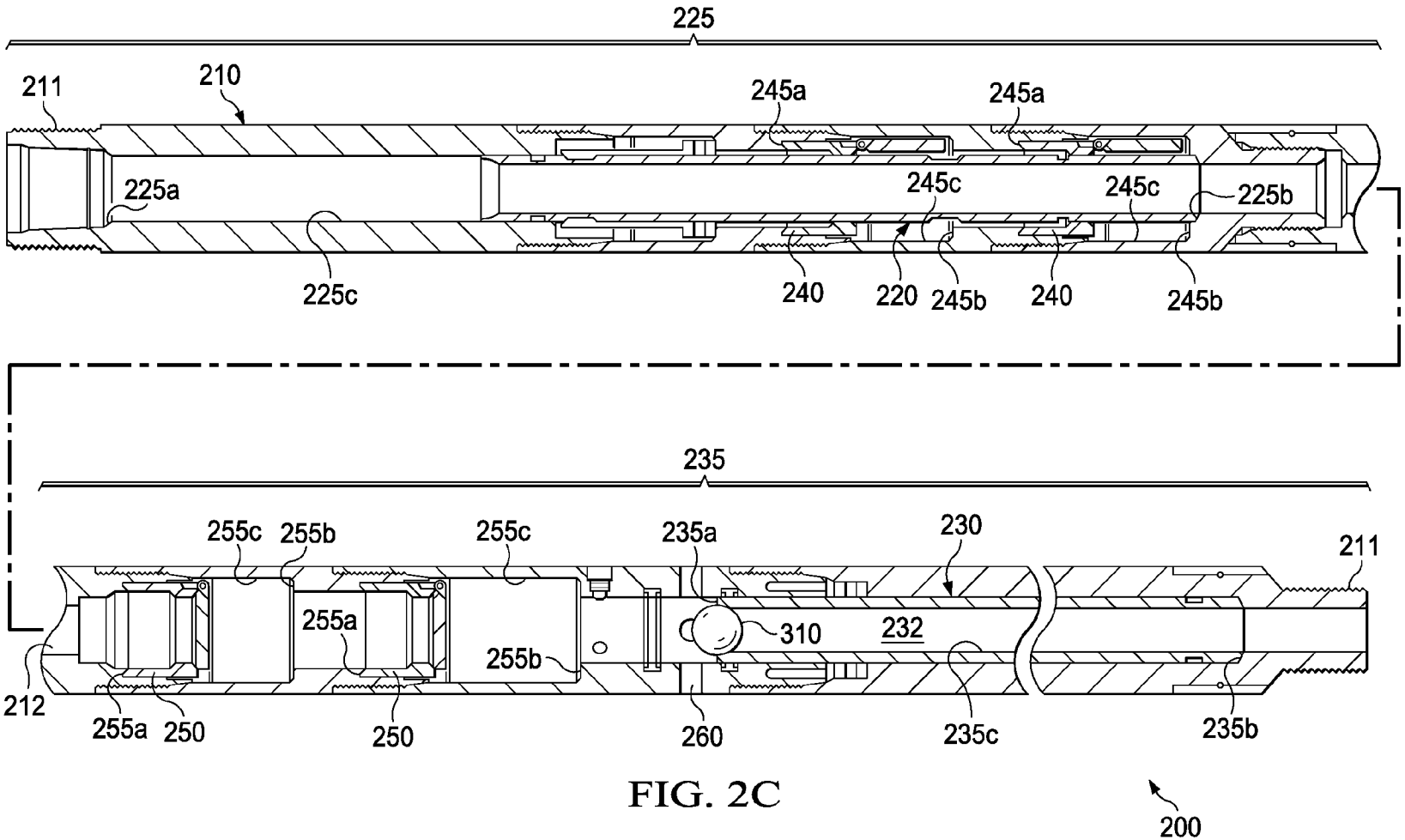
FIG. 2C is a cut-away illustration of a wellbore isolation device shown in a trip-out configuration.

Each of these components may be formed from a material suitable for that particular component. Examples of such suitable materials may include but are not limited to metal alloys, composite materials, phenolic materials, rubbers, plastics, thermo-plastic materials, thermoset materials, casted materials, molded materials, clad materials, ceramic materials, drillable materials, or combinations thereof. Referring to FIG. 2B, an embodiment of the WID 200 is illustrated in an operational mode, and, referring to FIG. 2C, an embodiment of the WID 200 is illustrated in a trip-out mode. In the embodiment of FIGS. 2A-2C, the first sliding sleeve 220 may be located up-hole relative to the second sliding sleeve 230 and the second sliding sleeve 230 may be located down-hole relative to the first sliding sleeve 220. Also, in the embodiment of FIGS. 2A-2C, the first sliding sleeve 220 may be configured to interact with the first valve assembly 240 and the second sliding sleeve 230 may be configured to the interact with the second valve assembly 250 and/or one or more ports within the tubular body.

In an embodiment, the tubular body 210 generally comprises a cylindrical or tubular structure. The body 210 may comprise a unitary structure; alternatively, the tubular body 210 may be comprise two or more operably connected components (e.g., two or more coupled sub-components, such as by a threaded connection). Alternatively, a tubular body like tubular body 210 may comprise any suitable structure, such suitable structures will be appreciated by those of skill in the art with the aid of this disclosure.

The tubular body 210 may be configured for connection to and/or incorporation within a string such as work string 150. For example, in such an embodiment, the tubular body 210 may comprise a suitable means of connection to the work string 150 (e.g., to a work string member such as coiled tubing, jointed tubing, or combinations thereof). For example, as illustrated in FIGS. 2A-2C, the terminal ends of the body 210 of the WID 200 may comprise one or more internally or externally threaded surfaces 211, for example, as may be suitably employed in making a threaded connection to the work string 150. Alternatively, a WID may be incorporated within a work string by any suitable connection, such as, for example, via one or more quick-connector type connections. Suitable connections to a work string member will be known to those of skill in the art.

In the embodiment of FIGS. 2A-2C, the interior surface of the tubular body 210 at least partially defines an axial flowbore 212. Referring again to FIG. 1, the WID 200 is incorporated within the work string 150 such that the axial flowbore 212 of the WID 200 is in fluid communication with the axial flowbore 152 of the work string 150, for example, such that a fluid communicated via the axial flowbore 152 of the work string 150 will flow into and, as will be discussed herein, may flow through the WID 200 via axial flowbore 212 to the wellbore servicing apparatus 140.

In the embodiment of FIG. 2A-2C, the tubular body 210 comprises a first sliding sleeve recess 225 and a second sliding sleeve recess 235. The first sliding sleeve recess 225 and the second sliding sleeve recess 235 may generally comprise a passageway in which the first sliding sleeve 220 and the second sliding sleeve 230 may move longitudinally and/or axially within the axial flowbore 212. In an embodiment, the first sliding sleeve recess 225 and the second sliding sleeve recess 235 may comprise one or more longitudinal and/or axial grooves, guides, or the like, for example, to align one or more of the sliding sleeves. In the embodiment of FIGS. 2A-2C and as shown in detail in FIGS. 3A-3B, the first sliding sleeve recess 225 is generally defined by an upper shoulder 225*a*, a lower shoulder 225*b*, and the recessed bore surface 225*c* extending between the upper shoulder 225*a* and lower shoulder 225*b*. Similarly, in the embodiment of FIGS. 2A-2C and as shown in detail in FIGS. 4A-4B, the second sliding sleeve recess 235 is generally defined by an upper shoulder 235*a*, a lower shoulder 235*b*, and the recessed bore surface 235*c* extending between the upper shoulder 235*a* and lower shoulder 235*b*.

In the embodiment of FIG. 2A-2C, 3A-3B, and 4A-4B, the tubular body 210 also comprises a first valve assembly recess 245 and a second valve assembly recess 255. As shown, the first valve assembly recess 245 may be at least partially bounded by the first sliding sleeve recess 225 and the second valve assembly recess 255 may be at least partially bounded by the second sliding sleeve recess 235. The first valve assembly recess 245 and the second valve assembly recess 255 may generally comprise a recess in which the first valve assembly 240 and second valve assembly 250 may be housed and/or retained, respectively. In the embodiment of FIGS. 2A-2C and 3A-3B, the first valve assembly recess 245 is generally defined by an upper shoulder 245*a*, a lower shoulder 245*b*, and the recessed bore surface 245*c* extending between the upper shoulder 245*a* and lower shoulder 245*b*. Similarly, in the embodiment of FIGS. 2A-2C and 4A-4B, the second valve assembly recess 255 is generally defined by an upper shoulder 255*a*, a lower shoulder 255*b*, and the recessed bore surface 255*c* extending between the upper shoulder 255*a* and lower shoulder 255*b*.

In the embodiment of FIGS. 2A-2C, the tubular body 210 further comprises one or more ports 260. In this embodiment, the ports 260 extend radially outward from and/or inward toward the axial flowbore 212. As such, when the WID 200 is so-configured, the ports 260 may provide a route of fluid communication to/from the axial flowbore 212. The WID 200 may be configured such that the ports 260 provide a route of fluid communication between the axial flowbore 212 and the wellbore 114 and/or subterranean formation 102 (e.g. when the ports 260 are unobstructed). Alternatively, the WID 200 may be configured such that no fluid will be communicated via the ports 260 between the axial flowbore 212 and the wellbore 114 and/or subterranean formation 102 (e.g., when the ports 260 are obstructed).

Figure 3A:
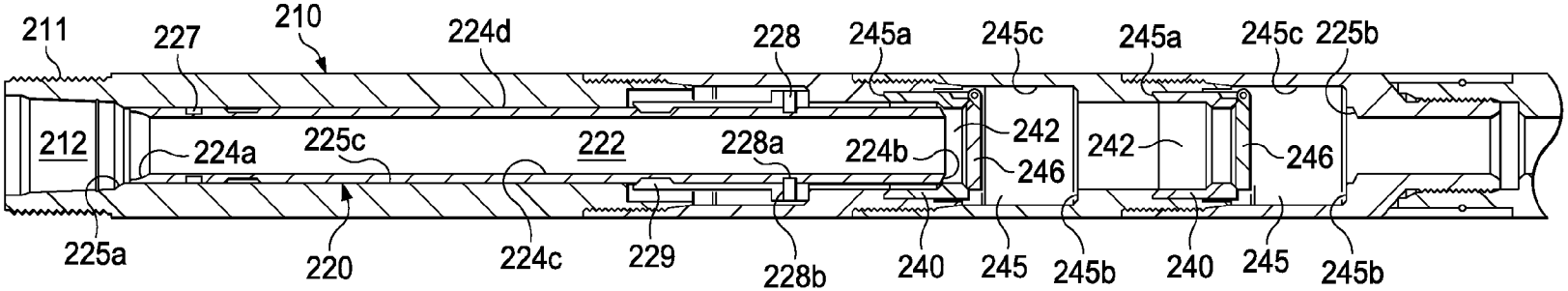
FIG. 3A is an expanded cut-away illustration of a portion of a wellbore isolation device showing a first sliding sleeve in a first position and a first valve assembly retained in an deactivated configuration.
Figure 3B:
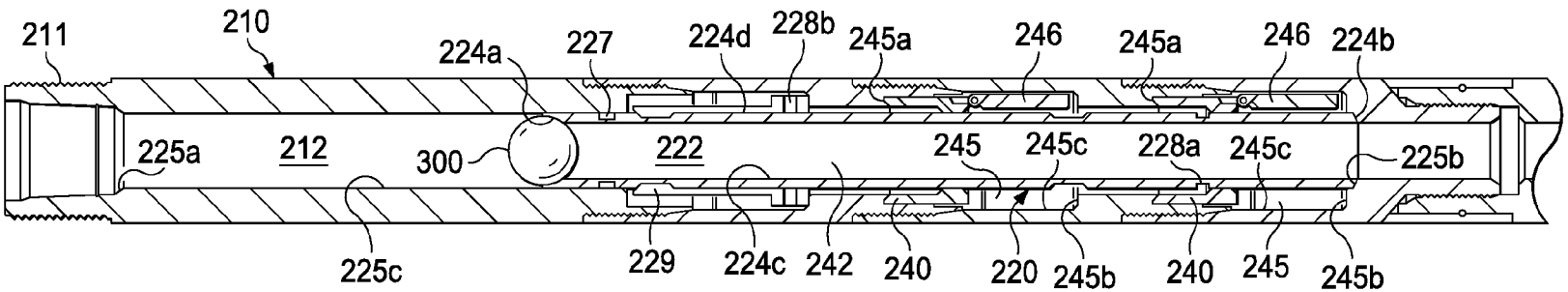
FIG. 3B is an expanded cut-away illustration of a portion of a wellbore isolation device showing a first sliding sleeve in a second position and a first valve assembly in an activated configuration.

In an embodiment, the first sliding sleeve 220 generally comprises a cylindrical or tubular structure. Referring to FIGS. 3A and 3B, in an embodiment, the first sliding sleeve 220 generally comprises an upper orthogonal face 224*a*, a lower orthogonal face 224*b*, an inner cylindrical surface 224*c* at least partially defining an axial flowbore 222 extending therethrough, and an outer cylindrical surface 224*d*. In an embodiment, the axial flowbore 222 defined by the first sliding sleeve 220 may be coaxial with and in fluid communication with the axial flowbore 212 defined by the tubular body 210. In the embodiment of FIGS. 3A and 3B, the first sliding sleeve 220 may comprise a single component piece. In an alternative embodiment, a sliding sleeve like the first sliding sleeve 220 may comprise two or more operably connected or coupled component pieces.

Referring to FIGS. 3A and 3B, in an embodiment, the first sliding sleeve 220 may be slidably and concentrically positioned within the tubular body 210. In the embodiment of FIGS. 3A and 3B, the first sliding sleeve 220 may be positioned within the first sliding sleeve recess 225. For example, at least a portion of the outer cylindrical surface 224*d* of the first sliding sleeve 220 may be slidably fitted against at least a portion of the recessed bore surface 225*c*.

In an embodiment, the first sliding sleeve 220, the first sliding sleeve recess 225, or both may comprise one or more seals at interface between the outer cylindrical surface 224*d* of the first sliding sleeve 220 may and the recessed bore surface 225*c*. For example, in the embodiment of FIGS. 3A and 3B, the first sliding sleeve 220 further comprises a radial or concentric recess or groove configured to receive a suitable fluid seal such as fluid seal 227, for example, to restrict fluid movement via the interface between the first sliding sleeve 220 and the first sliding sleeve recess 225. Suitable seals include but are not limited to a T-seal, an O-ring, a gasket, or combinations thereof.

In an embodiment, the first sliding sleeve 220 may be slidably movable between a first position and a second position within the first sliding sleeve recess 225. Referring again to FIG. 3A, the first sliding sleeve 220 is shown in the first position. In the first position, the upper orthogonal face 224*a* of the first sliding sleeve 220 may abut the upper shoulder 225*a* of the first sliding sleeve recess 225. When the first sliding sleeve 220 is in the first position, the first sliding sleeve 220 may be characterized as in its upper-most position within the first sliding sleeve recess 225 relative to the tubular body 210. Referring again to FIG. 3B, the first sliding sleeve 220 is shown in the second position. In the second position, the lower orthogonal face 224*b* of the first sliding sleeve 220 may abut the lower shoulder 225*b* of the first sliding sleeve recess 225. When the first sliding sleeve 220 is in the second position, the first sliding sleeve 220 may be characterized as in its lower-most position within the first sliding sleeve recess 225 relative to the tubular body 210.

In an embodiment, the first sliding sleeve 220 may be held in the first position and/or the second position by suitable retaining mechanism. For example, in the embodiment of Figured 3A, the first sliding sleeve 220 is retained in the first position by one or more shear-pins 228 or the like. The shear pins may be received by shear-pin bore 228*a* within the first sliding sleeve 220 and shear-pin bore 228*b* in the tubular body 210.

Also, in the embodiment of FIG. 3B, the first sliding sleeve may be retained in the second position by one or more collets 229, alternatively, a snap-ring, a C-ring, a pin, ratchet teeth, or combinations thereof. The collet 229 may be carried in a suitable slot, groove, channel, bore, or recess in the tubular body 210, alternatively, in the first sliding sleeve 220, and may expand into and be received by a suitable slot groove, channel, bore, or recess in the first sliding sleeve, alternatively, in the tubular body 210.

Figure 4A:
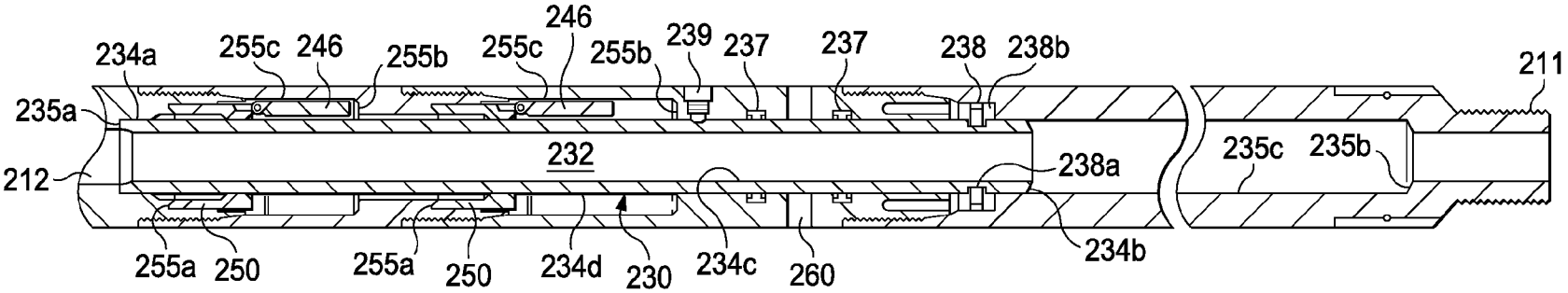
FIG. 4A is an expanded cut-away illustration of a portion of a wellbore isolation device showing a second sliding sleeve in a first position and a first valve assembly retained in an deactivated configuration.
Figure 4B:
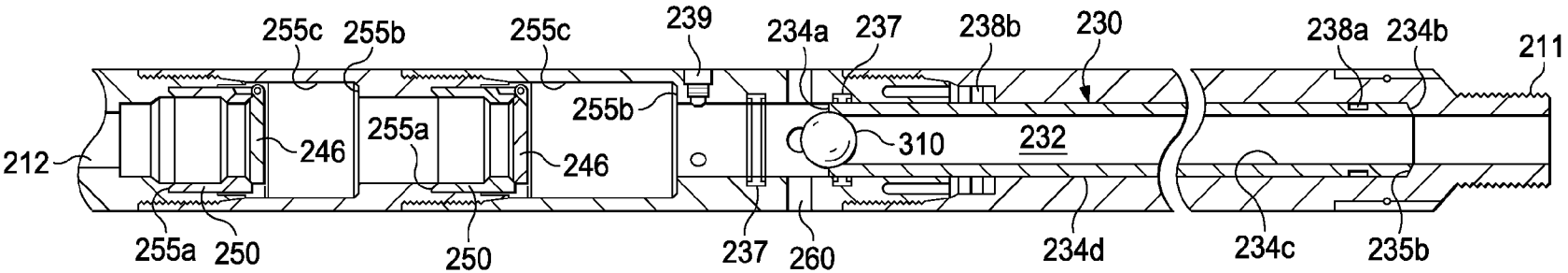
FIG. 4B is an expanded cut-away illustration of a portion of a wellbore isolation device showing a second sliding sleeve in a second position and a first valve assembly in an activated configuration.

In an embodiment, the second sliding sleeve 230 generally comprises a cylindrical or tubular structure. Referring to FIGS. 4A and 4B, in an embodiment, the second sliding sleeve 230 generally comprises an upper orthogonal face 234*a*, a lower orthogonal face 234*b*, an inner cylindrical surface 234*c* at least partially defining an axial bore 232 extending therethrough, and an outer cylindrical surface 234*d*. In an embodiment, axial flowbore 232 defined by the second sliding sleeve 230 may be coaxial with and may be in fluid communication with the axial flowbore 212 defined by the tubular body 210. In the embodiment of FIGS. 4A and 4B, the second sliding sleeve 230 may comprise a single component piece. In an alternative embodiment, a sliding sleeve like the second sliding sleeve 230 may comprise two or more operably connected or coupled component pieces.

Referring to FIGS. 4A and 4B, in an embodiment, the second sliding sleeve 230 may be slidably and concentrically positioned within the tubular body 210. In the embodiment of FIGS. 4A and 4B, the second sliding sleeve 230 may be positioned within the second sliding sleeve recess 235. For example, at least a portion of the outer cylindrical surface 234*d* of the second sliding sleeve 230 may be slidably fitted against at least a portion of the recessed bore surface 235*c*.

In an embodiment, the second sliding sleeve recess 235, the second sliding sleeve 230 may, or both comprise one or more seals at interface between the outer cylindrical surface 234*d* of the second sliding sleeve 230 may and the recessed bore surface 235*b*. For example, in the embodiment of FIGS. 4A and 4B, the second sliding sleeve recess 235 further comprises a radial or concentric recess or groove configured to receive a suitable fluid seal such as fluid seal 237, for example, to restrict fluid movement via the interface between the second sliding sleeve 230 and the second sliding sleeve recess 235. Suitable seals include but are not limited to a T-seal, an O-ring, a gasket, or combinations thereof.

In an embodiment, the second sliding sleeve 230 may be slidably movable between a first position and a second position within the second sliding sleeve recess 235. Referring again to FIG. 4A, the second sliding sleeve 230 is shown in the first position. In the first position, the upper orthogonal face 234*a* of the second sliding sleeve 230 may abut the upper shoulder 235*a* of the second sliding sleeve recess 235. When the second sliding sleeve 230 is in the first position, the second sliding sleeve 230 may be characterized as in its upper-most position within the second sliding sleeve recess 235 relative to the tubular body 210. Referring again to FIG. 4B, the second sliding sleeve 230 is shown in the second position. In the second position, the lower orthogonal face 234*b* of the second sliding sleeve 230 may abut the lower shoulder 235*b* of the second sliding sleeve recess 235. When the second sliding sleeve 230 is in the second position, the second sliding sleeve 230 may be characterized as in its lower-most position within the second sliding sleeve recess 235 relative to the tubular body 210.

In an embodiment, the second sliding sleeve 230 may be held in the first position and/or the second position by suitable retaining mechanism. For example, in the embodiment of Figured 4A, the second sliding sleeve 230 is retained in the first position by one or more shear-pins 238 or the like. The shear pin may be received by shear-pin bore 238*a* within the second sliding sleeve 230 and shear-pin bore 238*b* in the tubular body 210.

Also, in the embodiment of FIG. 4B, the second sliding sleeve may be retained in the second position by a biased button or pin 239, alternatively, a snap-ring, a C-ring, a pin, ratchet teeth, or combinations thereof. The pin or button 229 may be carried in a suitable bore, slot, groove, channel, or recess in the tubular body 210 and may be retained in a compressed or retracted state within such a bore when the second sliding sleeve 230 is in the first position and may extend at least partially from that bore into the axial flowbore 212 when the second sliding sleeve 230 is in the second position, thereby inhibiting the second sliding sleeve from moving upward beyond the pin or button 229.

In an embodiment, the upper orthogonal face 224*a* of the first sliding sleeve 220 and the upper orthogonal face 234*a* of the second sliding sleeve 230 may each comprise a bevel, chamfer, or other suitable shape for forming a seat (e.g., a ball seat) configured to receive, retain, and/or engage an obturating member (e.g., a ball or dart 300 or 310) of a particular size and configuration moving via the axial flowbore 212. In an embodiment where the first sliding sleeve 220 is located up-hole relative to the second sliding sleeve 230, the upper orthogonal face 224*a* of the first sliding sleeve 220 may be configured to engage and retain a relatively larger obturating member and to not engage or retain an obturating member of a relatively smaller size. The upper orthogonal face 234*a* of the second sliding sleeve 230 may configured to engage a relatively smaller obturating member. In such an embodiment, an obturating member of a relatively smaller size and/or shape flowing via the flowbore may be configured to pass through the upper orthogonal face 224*a* and the axial flowbore 222 of the first sliding sleeve 220 and engage and be retained by the upper orthogonal face 234*a* of the second sliding sleeve 230.

In an embodiment, the first valve assembly 240 and/or the second valve assembly 250 may be characterized as one-way valves. For example, the first valve assembly 240 and the second valve assembly 250 may be configured to allow fluid flow therethrough in one direction and to restrict fluid flow in the opposite direction. In an embodiment, a valve assembly, such as the first valve assembly 240 and/or the second valve assembly 250, may be characterized as both activatable and deactivatable. For example, when the first valve assembly 240 and/or the second valve assembly 250 is in an activated configuration, the first valve assembly 240 and/or the second valve assembly 250 allow fluid flow therethrough in one direction and restrict fluid flow in the opposite direction. Alternatively, in an deactivated configuration, the first valve assembly 240 and/or the second valve assembly 250 allow fluid flow therethrough in both directions.

Figure 5A:
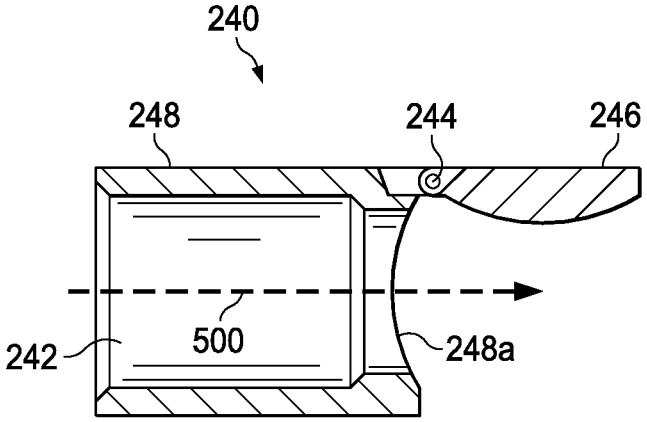
FIG. 5A is an expanded cut-away illustration of an open valve assembly.
Figure 5B:
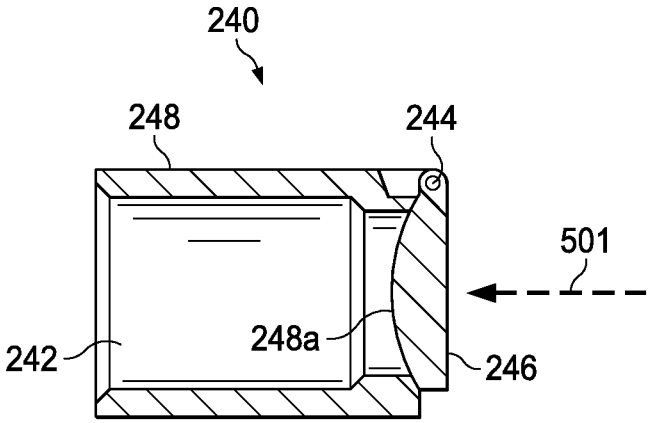
FIG. 5B is an expanded cut-away illustration of a closed valve assembly.

Referring to FIGS. 5A and 5B, an embodiment of a suitable valve assembly (e.g., a "flapper" valve assembly), for example, such as the first valve assembly 240 is illustrated in isolation. In an embodiment, the second valve assembly 250 may employ the same or a similar type and/or configuration as the first valve assembly 240 shown in FIGS. 5A and 5B. As noted above, a WID like WID 200 may employ multiple first valve assemblies 240 and/or multiple second valve assemblies. In an embodiment, the first valve assembly 240 may comprise or be characterized as a check valve, a swinging-gate valve, a flapper valve, a clapper valve, or combinations thereof. In the embodiment of FIGS. 5A and 5B, the first valve assembly 240 generally comprises a valve body 248, a hinge 244, and a gate 246 (sometimes referred to as a flapper). The valve body 248 may generally comprise cylindrical or tubular structure at least partially defining an axial flowbore 242 extending therethrough. The valve body 248 may further comprise a seat 248A configured to engage the gate 246. As shown in FIGS. 5A and 5B, the gate 246 may be at least partially rotatably fixed to the valve body 248 via the hinge 244. The gate 246 may be biased, for example, via a spring or other suitable biasing member, such that the gate 246 will close against the valve seat 248A when not otherwise acted upon (e.g., not held open by the first or second sliding sleeve 220 or 230). The gate 246 may be characterized as a concave plate or disc. In embodiment, the seat 248A and the gate 246 may be configured such that, when the gate 248 engages the seat 246A, fluid will not pass. For example, where the gate 246 comprises a generally concave shape, the seat 248A may be configured to mate with and/or engage such a concave gate 246. Alternatively, where the gate 246 comprises a generally flat shape, the seat 248A may be configured to mate with and/or engage such a flat gate 246. Referring to FIG. 5A, when fluid is flowed in a first direction (e.g., as shown by flow arrow 500), for example, when fluid is forward-circulated, the movement of the fluid forces open the gate 246, causing the gate 246 to disengage the seat 248A and allowing the forward-movement of fluid therethrough. Referring to FIG. 5B, when fluid is flowed in the opposite direction (e.g., as shown by flow arrow 501), for example, when fluid is reverse-circulated, the gate 246 closes, for example, because the gate may be biased in a closed position, thereby blocking the backward movement of fluid.

Referring to FIG. 2A, the WID 200 is shown in the trip-in mode. In the trip-in mode, the first sliding sleeve 220 is retained in the first position by shear pin 228 (as shown in FIG. 3A) and the second sliding sleeve is retained in the first position by shear pin 238 (as shown in FIG. 4A). When the first sliding sleeve 220 is in the first, relatively most up-hole position, the first valve assembly 240 is in its activated configuration. That is, the first valve assembly 240 will allow forward-circulation of fluid (e.g., downward circulation) via the axial flowbore 212 and will restrict reverse-circulation of fluid (e.g., upward circulation or backflow) via the axial flowbore 212. When the second sliding sleeve 230 is in the first, relatively, most up-hole position, the second valve assembly 250 may be retained within the second valve assembly recess 255 in an deactivated configuration and will not restrict either the forward-circulation of fluid or the reverse-circulation of fluid via the axial flowbore 212. In the embodiment of FIGS. 2A and 4A, the second sliding sleeve 230 may extend at least partially through the axial flowbore defined by the valve body of the second valve assembly 250 (similar to the axial flowbore 242 defined by the valve body 248 of the first valve assembly 240 discussed above with reference to FIGS. 5A and 5B), thereby holding open the gate 246 of the second valve assembly 250 (similar to the gate 246 of the first valve assembly 240). In an embodiment, the second sliding sleeve 230 may be sized to slidably fit within the axial flowbore of the second valve assembly 250, for example, the outside diameter of the second sliding sleeve 230 may be slightly smaller than the inner bore defined by the valve body of the second valve assembly 250.

Also in the embodiment of FIGS. 2A and 4A, when the second sliding sleeve 230 is in the first position, the second sliding sleeve 230 may obstruct or obscure the ports 260 such that no fluid will be communicated via the ports 260 between the axial flowbore 212 and the wellbore 114 and/or the subterranean formation 102.

Referring to FIG. 2B, the WID 200 is shown in the operational mode. In the operational mode, the first sliding sleeve 220 is transitioned to the second position, as will be discussed herein and is retained in the second position by the collets 229 (as shown in FIG. 3B) and the second sliding sleeve 230 continues to be retained in the first position by shear pin 238 (as shown in FIG. 4A and as described above). When the first sliding sleeve 220 is in the second, relatively most down-hole position, the first valve assembly 240 may be retained in the first valve assembly recess 245 in its deactivated configuration. That is, the first valve assembly will not restrict either the forward-circulation of fluid or the reverse-circulation of fluid via the axial flowbore 212. In the embodiment of FIGS. 2B and 3B, the first sliding sleeve 220 may extend at least partially through the axial flowbore 242 defined by the valve body 248 of the first valve assembly 240, thereby holding open the gate 246 of the first valve assembly 250. In an embodiment, the first sliding sleeve 220 may be sized to slidably fit within the axial flowbore 242 of the first valve assembly 240, for example, the outside diameter of the first sliding sleeve 220 may be slightly smaller than the flowbore 242 defined by the valve body 248 of the first valve assembly 240.

Referring to FIG. 2C, the WID 200 is shown in the trip-out mode. In the trip-out mode, the first sliding sleeve 220 continues to be retained in the second position by the collets 229 (as shown in FIG. 3B and as described above) and the second sliding sleeve 230 is transitioned to the second position and is retained in the second position by biased button or pin 239. When the second sliding sleeve 230 is in the second, relatively most down-hole position, the second valve assembly 250 is in its activated configuration. That is, the second valve assembly 250 will restrict reverse-circulation of fluid (e.g., upward circulation or backflow) via the axial flowbore 212. In the embodiment of FIGS. 2C and 4B, the second sliding sleeve 230 no longer extends through the axial flowbore defined by the valve body of the second valve assembly 250 (similar to the axial flowbore 242 defined by the valve body 248 of the first valve assembly 240 discussed above with reference to FIGS. 5A and 5B) and, therefore, no longer holds open the gate 246 of the second valve assembly 250 (similar to the gate 246 of the first valve assembly 240).

Also, in the embodiments of FIGS. 2C and 4B, when the second sliding sleeve 230 is in the second position, the second sliding sleeve 230 may no longer obstruct or obscure the ports 260 such that the ports 260 provide a route of fluid communication between the axial flowbore 212 and the wellbore 114 and/or subterranean formation 102.

Also disclosed herein are methods utilizing a WID such as the WID 200 as disclosed herein. In an embodiment, a WID such as WID 200 may be employed in the performance of a wellbore servicing operation. In an embodiment, a wellbore servicing method may generally comprise the steps of incorporating a WID like WID 200 within a work string such as work string 150, positioning the work string 150 comprising the WID 200 within the wellbore 114 in the trip-in configuration, transitioning the WID 200 to the operational configuration, communicating a wellbore servicing fluid to the subterranean formation, transitioning the WID 200 to the trip-out configuration, and removing the work string 150 comprising the WID 200.

Referring again to FIG. 1, in an embodiment, the WID 200 may be incorporated within the work string 150 by connecting the WID 200 to the work string 150 via a suitable connection during run-in or trip-in. The WID 200 may be configured in the trip-in mode when it is incorporated within the work string 150. In an additional embodiment, a second, third, fourth, or other additional WID such as WID 200 may also be incorporated within the work string 150, as will be appreciated by one of skill in the art with the aid of this disclosure.

In an embodiment, once the WID 200 has been incorporated within the work string 150, the work string 150 comprising the WID 200 may be lowered into the wellbore 114 to a sufficient or desired position. For example, the work string 150 may be positioned within the wellbore 114 such that a wellbore servicing apparatus like wellbore servicing apparatus 140 incorporated within the work string 150 may be positioned adjacent or proximate to a portion of the subterranean formation to be serviced (e.g., a servicing interval).

As noted above, while the WID 200 is in the trip-in configuration, the WID 200 will allow the forward-circulation of fluid and restrict reverse-circulation of fluid (e.g., back-flow)

via the flowbore of the work string 150. As such, fluid may be forward-circulated but will not back-flow via the work string 150 during trip-in or run-in.

In an embodiment, positioning the work string 150 may also comprise isolating the servicing interval, for example, via the actuation and operation of a suitable wellbore isolation device. Such a wellbore isolation device may comprise a mechanical packer, a swellable packer, or combinations thereof and may be configured, when actuated, to isolate two or more depths or intervals within a wellbore from each other by providing a barrier concentrically about a work string.

In an embodiment, after the WID 200 has been positioned within the wellbore 114, the WID 200 may be transitioned from the trip-in configuration in which, as disclosed above, the first sliding sleeve 220 is in the first position and the second sliding sleeve 230 is the first position, to the operational configuration in which, as disclosed above, the first sliding sleeve 220 is in the second position and the second sliding sleeve 230 is the first position. Referring to FIG. 2B, in an embodiment, transitioning the WID 200 from the trip-in configuration to the operational configuration may comprise introducing a first obturating member 300 (e.g., a ball) configured to engage and be retained by the seat (e.g., the upper orthogonal face 224*a*) of the first sliding sleeve 220 into the axial flowbore 152 of the work string 150 and forward-circulating the first obturating member 300 to engage the seat of the first sliding sleeve 220. When the first obturating member 300 reaches and engages the seat of the first sliding sleeve 220, the first obturating member 300 may interact with the seat to restrict the passage of fluid. Continued pumping may increase the fluid pressure downwardly applied to the first sliding sleeve 220 via the first obturating member 300, causing the shear pin 228 to break or shear and the first sliding sleeve 220 to move downward longitudinally or axially within the WID 200 to its second position. As the first sliding sleeve 220 moves into the second position, collet fingers 229 engage slots or grooves in the first sliding sleeve 220 and retain the sleeve in the second position. As noted above, when the first sliding sleeve 220 is in the second position, the first sliding sleeve 220 will hold open the gate 246 of the first valve assembly 240 such that the first valve assembly is deactivated and, as such, will not restrict either forward-circulation or reverse-circulation of a fluid. When the WID 200 has been transitioned to the operational mode, the first obturating member 300 may be removed, for example, via reverse circulation. Therefore, as noted above, while the WID 200 is in the operational configuration, the WID 200 will allow the forward-circulation of fluid and the reverse-circulation of fluid (e.g., back-flow) via the axial flowbore 152 of the work string 150.

In an embodiment, with the WID 200 in the operational mode, a given servicing operation may be performed with respect to the subterranean formation 102 or a portion thereof (e.g., a service interval) by communicating a servicing fluid to the subterranean formation 102. In an embodiment, such a servicing operation may comprise forward-circulating a fluid via the axial flowbore 152 of the work string 150, reverse-circulating a fluid via the axial flowbore 152 of the work string 150, or combinations thereof. Examples of such servicing operations may include but are not limited to a fracturing operation, a hydrajetting operation, an acidizing operation, a plug mill-out operation, a cleanout operation, a sidetrack operation, a matrix treatment operation, a conformance operation, a production operation (such as a velocity string), a drilling operation, a logging operation, or combinations thereof. Such wellbore servicing operations may comprise the communication of various fluids as will be appreciated by one of skill in the art with the aid of this disclosure.

In an embodiment, when the servicing operation has been completed with respect to one or more desired servicing intervals, the WID 200 may be transitioned from the operational configuration, as disclosed above, to the trip-out configuration in which, as disclosed above, the first sliding sleeve 220 is in the second position and the second sliding sleeve 230 is the second position. Referring to FIG. 2C, in an embodiment, transitioning the WID 200 from the operational configuration to the trip-out configuration may comprise introducing a second obturating member 310 (e.g., a ball) configured to pass through axial flowbore 222 of the first sliding sleeve 220 and engage and be retained by the seat (e.g., the upper orthogonal face 234*a*) of the second sliding sleeve 230 into the axial flowbore 152 of the work string 150 and forward-circulating the second obturating member 310 to engage the seat of the second sliding sleeve 230. When the second obturating member 310 reaches and engages the seat of the second sliding sleeve 230, the second obturating member 310 may interact with the seat to restrict the passage of fluid. Continued pumping may increase the fluid pressure downwardly applied to the second sliding sleeve 230 via the second obturating member 310, causing the shear pin 238 to break or shear and the second sliding sleeve 230 to move downward longitudinally or axially within the WID 200 to its second position. As the second sliding sleeve 230 moves into the second position, biased button or pin 239 extends into the axial flowbore 212, thereby impeding the second sliding sleeve 230 from upward longitudinal movement within the second sliding sleeve recess 235 and thereby retaining the sleeve in the second position. In an alternative embodiment, the sliding sleeve 230 may be retained in the second position by any one or more suitable mechanisms, for example, a collet, a C-ring, a ratchet mechanism, a teethed mechanism. Alternatively, the sliding sleeve 230 may be left free floating in the second position and the biased gate 246 may act as a barrier to prevent sliding sleeve 230 to move back to first position. As noted above, when the second sliding sleeve 230 is in the second position, the second sliding sleeve 230 will no longer hold open the biased gate 246 of the second valve assembly 250 such that the second valve assembly is activated and, as such, will allow forward-circulation while restricting reverse-circulation of a fluid. Therefore, as noted above, while the WID 200 is in the trip-out configuration, the WID 200 will restrict the reverse-circulation of fluid (e.g., back-flow) via the axial flowbore 152 of the work string 150.

In an embodiment, when the WID 200 has been transitioned to trip-out mode, the work string 150 may be removed from (e.g., run out of) the wellbore 114.

It is noted that, in an embodiment, when the WID has been transitioned to trip-out mode, forward-circulation through the axial flowbore 212 of the WID 200 may be restricted because the second obturating member 310 may remain engaged with the seat (e.g., the upper orthogonal face 234*a*) of the second sliding sleeve 230 and thereby blocking fluid communication. For example, because the second valve assembly 250 is activated upward from the position of the second obturating member 310 as shown in FIG. 2C, the second valve assembly 250 may block removal of the second obturating member 310 by reverse circulation.

Figure 6:
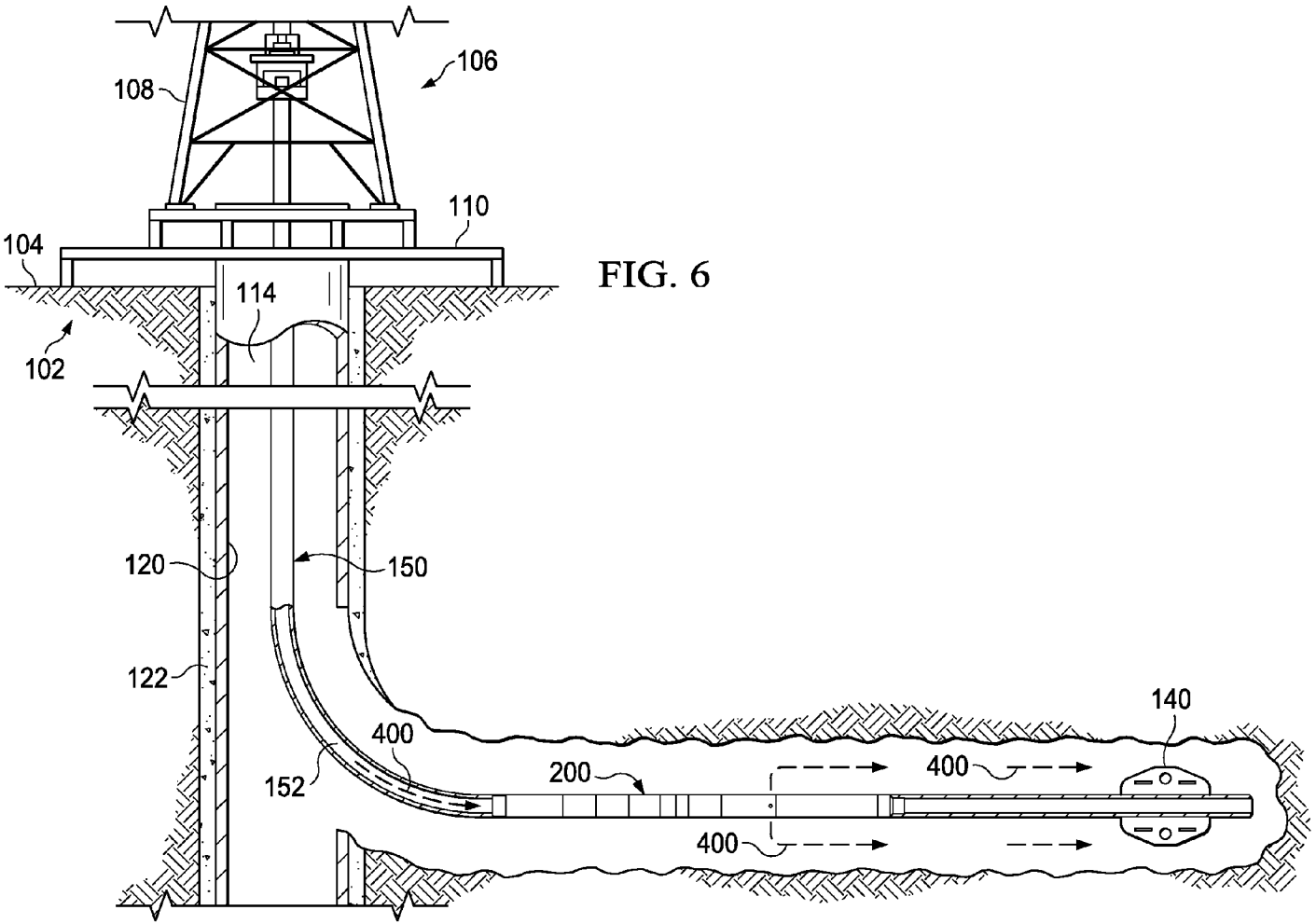
FIG. 6 is a cut-away illustration of an environment for a wellbore servicing operation and illustrating the delivery of a kill fluid.

In an alternative and/or additional embodiment, it may be necessary or advantageous to "kill" a well at some point during the performance of servicing operation or thereafter. In such an embodiment, it may be necessary to pump or otherwise deliver a kill fluid (e.g., a heavy mud or cement) within the wellbore to cease fluid flow from the subterranean formation into the wellbore. In an embodiment where it is necessary to perform such well-kill operation, if the WID 200 is configured in either the trip-in mode or the operational mode, the kill fluid may be delivered via the axial flowbore of the work string 150. However, if the WID 200 has been transitioned to the trip-out mode, fluid may not be delivered via the axial flowbore 152 of the work string 150 because the second obturating member 310 may restrict the passage of fluid. Where the WID 200 is configured in the trip-out mode, the kill fluid may be delivered via a combination of the annular space about the work string 150, the ports 260, and the axial flowbore of the work string 150. For example, referring the embodiment of FIG. 6, the kill fluid (represented by flow arrow 400) may be flowed downward through the axial flowbore of the work string 150 until the kill fluid reaches the second obturating member 310 and the ports 260. The kill fluid may flow into the annular space within the wellbore 114 surrounding the work string 150 and continue downward and into the formation 102 or a portion thereof.

In an embodiment, a WID like the WID 200 disclosed herein may allow an operator to selectively isolate an active well via the operation of the WID 200 as disclosed herein. Particularly, the WID 200 allows an operator to selectively allow forward circulation of a fluid while restricting back-flow via a work string (e.g., during trip-in), then selectively allow both forward circulation and reverse circulation (e.g., during the performance of a servicing operation), then selectively allow forward circulation of a fluid while restricting back-flow via a work string (e.g., during trip-out). The ability to selectively allow and disallow reverse-circulation while allowing forward-circulation may improve safety of workers by guarding against unforeseen backflow from a work string during trip in and out of the wellbore 114.

In an embodiment, the WID 200, while configured in the operational mode, may allow for reverse circulation via the work string, which may thereby allow prevention or avoidance of issues associated with a screen-outs. For example, reverse circulation may clear any clogging within the work string. In stimulation operations where large amount of sand is pumped through the tool, this may be particularly advantageous.

Figure 7A:
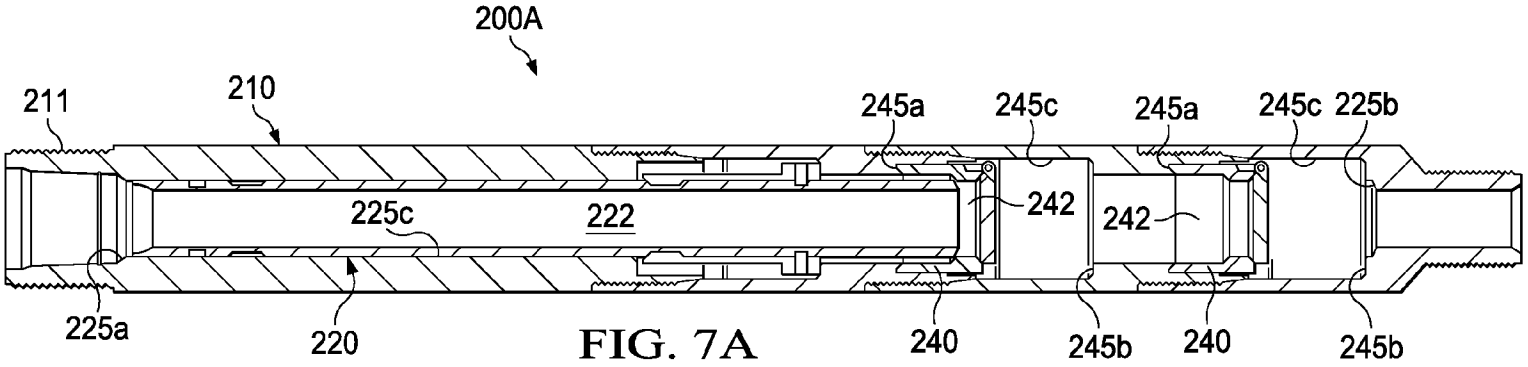
FIG. 7A is a cut-away illustration of a first assemblage of a wellbore isolation device.
Figure 7B:
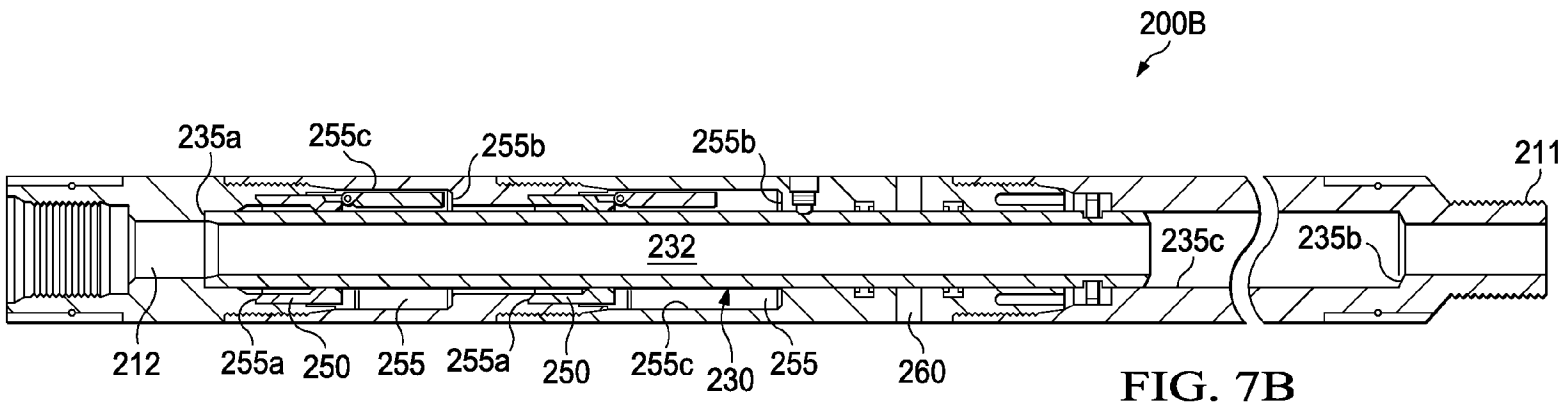
FIG. 7B is a cut-away illustration of a second assemblage of a wellbore isolation device.

In an embodiment, a WID may be separatable or divisable into two or more assemblages of the components disclosed herein. For example, referring to FIGS. 7A and 7B, a WID divided into a first assemblage 200A and a second assemblage 200B is illustrated. In the embodiment of FIGS. 7A and 7B, the first assemblage 200A comprises a first sliding sleeve 220 and a first valve assembly 240 and is similarly operable as disclosed herein above and the second assemblage 200B comprises a second sliding sleeve 230 and a second valve assembly 250 and is similarly operable as disclosed herein above. In an embodiment, the first assemblage 200A and the second assemblage 200B may be employed together as discussed herein above. In an alternative embodiment, the first assemblage 200A may be employed independent from the second assemblage 200B or, alternatively, the second assemblage 200B may be employed independent from the first assemblage 200A. For example, in an embodiment where a well is already "dead" or inactive, the first assemblage 200A may not be needed and, as such, the second assemblage 200B may be employed independent of or without the first assemblage 200A. Alternatively, where a live well is "killed" or made inactive during the performance of an operation, the second assemblage 200B may not be needed and, as such, the first assemblage 200A may be employed independent of the second assemblage 200B.

ADDITIONAL DISCLOSURE

The following are nonlimiting, specific embodiments in accordance with the present disclosure:

Embodiment A

A wellbore servicing apparatus comprising:

a tubular body at least partially defining an axial flowbore;

a first valve assembly, positioned within the tubular body, wherein, when activated, the first valve assembly will restrict fluid communication via the axial flowbore in a first direction and allow fluid communication in a second direction, and, when deactivated, the first valve assembly will allow fluid communication via the axial flowbore in the first direction and the second direction;

a first sliding sleeve slidable within the tubular body and transitionable from a first position to a second position, wherein, when the first sliding sleeve is in the first position, the first valve is in the activated mode, and, when the first sliding sleeve is in the second position, the first valve is retained in the deactivated mode;

a second valve assembly, positioned within the tubular body downhole from the first valve assembly, wherein, when activated, the second valve assembly will restrict fluid communication via the axial flowbore in the first direction and allow fluid communication in the second direction, and, when deactivated, the second valve assembly will allow fluid communication via the axial flowbore in the first direction and the second direction; and a second sliding sleeve slidable within the tubular body and transitionable from a first position to a second position, wherein, when the second sliding sleeve is in the first position, the second valve is retained in the deactivated mode, and, when the first sliding sleeve is in the second position downhole from the first position, the second valve is in the activated mode.

Embodiment B

The wellbore servicing apparatus of Embodiment A, wherein the wellbore servicing apparatus is incorporated within a work string.

Embodiment C

The wellbore servicing apparatus of one of Embodiments A through B, wherein, when the first sliding sleeve is in the first position and the second sliding sleeve is in the first position, forward-circulation via the axial flowbore will be allowed and reverse-circulation via the axial flowbore will be restricted.

Embodiment D

The wellbore servicing apparatus of one of Embodiments A through C, wherein, when the first sliding sleeve is in the second position and the second sliding sleeve is in the first position, forward-circulation via the axial flowbore and/or reverse-circulation via the axial flowbore will be allowed.

Embodiment E

The wellbore servicing apparatus of one of Embodiments A through D, wherein, when the first sliding sleeve is in the second position and the second sliding sleeve is in the second position, forward-circulation via the axial flowbore will be allowed and reverse-circulation via the axial flowbore will be restricted.

Embodiment F

The wellbore servicing apparatus of one of Embodiments A through E, wherein the first sliding sleeve comprises a first seat configured to first engage a ball or a dart, wherein the second sliding sleeve comprises a second seat configured to engage the second ball or a dart, and wherein the first ball or dart is characterized as having a greater diameter than the second ball or dart.

Embodiment G

The wellbore servicing apparatus of one of Embodiments A through F, wherein the first valve assembly, the second valve assembly, or both comprises at least one flapper valve.

Embodiment H

The wellbore servicing apparatus of one of Embodiments A through G, wherein the first direction is up-hole and the second direction is down-hole.

Embodiment I

The wellbore servicing apparatus of Embodiments A through H, further comprising one or more ports, wherein the one or mores ports provide a route of fluid communication between the axial flowbore and an annular space in the wellbore when unobstructed, wherein the ports are obstructed when the second sliding sleeve is in the first position, and wherein the ports are unobstructed when the second sliding sleeve is in the second position.

Embodiment J

A wellbore servicing apparatus comprising an axial flowbore, the wellbore servicing apparatus being transitionable from a first mode to a second mode and transitionable from the second mode to a third mode, wherein, when the wellbore servicing apparatus is in the first mode, reverse-circulation via the axial flowbore is restricted and forward-circulation via the axial flowbore is allowed, when the wellbore servicing apparatus is in the second mode, forward-circulation and reverse-circulation via the axial flowbore is allowed, and when the wellbore servicing apparatus is in the third mode, reverse-circulation via the axial flowbore is restricted.

Embodiment K

The wellbore servicing apparatus of Embodiment J, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the first mode, the first valve assembly is in an activated configuration and the second sliding sleeve retains the second valve assembly in an deactivated configuration.

Embodiment L

The wellbore servicing apparatus of one of Embodiments J through K, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the second mode, the first sliding sleeve retains the first valve assembly in an deactivated configuration and the second sliding sleeve retains the second valve assembly in an deactivated configuration.

Embodiment M

The wellbore servicing apparatus of one of Embodiments J through L, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the third mode, the first sliding sleeve retains the first valve assembly in an deactivated configuration and the second valve assembly is in an deactivated configuration.

Embodiment N

A wellbore servicing method comprising:

positioning a wellbore servicing apparatus comprising an axial flowbore within a wellbore in a first mode, wherein, when the wellbore servicing apparatus is in the first mode, reverse-circulation via the axial flowbore is restricted and forward-circulation via the axial flowbore is allowed;

transitioning the wellbore servicing apparatus from the first mode to a second mode, wherein, when the wellbore servicing apparatus is in the second mode, forward-circulation and/or reverse-circulation via the axial flowbore is allowed; and transitioning the wellbore servicing apparatus from the second mode to a third mode, wherein, when the wellbore servicing apparatus is in the third mode, reverse-circulation via the axial flowbore is restricted.

Embodiment O

The wellbore servicing method of Embodiment N, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the first mode, the first valve assembly is in an activated configuration and the second sliding sleeve retains the second valve assembly in an deactivated configuration.

Embodiment P

The wellbore servicing method of one of Embodiments N through O, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the second mode, the first sliding sleeve retains the first valve assembly in an deactivated configuration and the second sliding sleeve retains the second valve assembly in an deactivated configuration.

Embodiment Q

The wellbore servicing method of one of Embodiments N through P, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the third mode, the first sliding sleeve retains the first valve assembly in an deactivated configuration and the second valve assembly is in an activated configuration.

Embodiment R

The wellbore servicing method of one of Embodiments N through Q, wherein moving the first sliding sleeve from the first position to the second position comprises circulating a first obturating member via the axial flowbore to engage the first sliding sleeve.

Embodiment S

The wellbore servicing method of Embodiment R, wherein moving the second sliding sleeve from the first position to the second position comprises circulating a second obturating member via the axial flowbore to engage the second sliding sleeve.

Embodiment T

The wellbore servicing method of one of Embodiments N through S, wherein the wellbore servicing apparatus comprises:

a first sliding sleeve operable to transition a first valve assembly from an active state to a deactive state;

a second sliding sleeve operable to transition a second valve assembly from a deactive state to an active state; and one or more ports operable to provide a route of fluid communication between the axial flowbore and an annular space in the wellbore when unobstructed, wherein the ports are obstructed when the second sliding sleeve is in a first position, and wherein the ports are unobstructed when the second sliding sleeve is in a second position.

Embodiment U

The wellbore servicing method of one of Embodiments N through T, further comprising communicating a fluid from the axial flowbore to the annular space in the wellbore.

Embodiment V

A wellbore servicing apparatus comprising:

a tubular body at least partially defining an axial flowbore;

a valve assembly, positioned within the tubular body, wherein, when activated, the valve assembly will restrict fluid communication via the axial flowbore in a first direction and allow fluid communication in a second direction, and, when deactivated, the valve assembly will allow fluid communication via the axial flowbore in the first direction and the second direction; and a sliding sleeve slidable within the tubular body and transitionable from a first position to a second position, wherein, when the sliding sleeve is in the first position, the second valve is retained in the deactivated mode.

Embodiment W

A wellbore servicing method comprising:

positioning a wellbore servicing apparatus comprising an axial flowbore within a wellbore in a first mode, wherein, when the wellbore servicing apparatus is in the first mode, forward-circulation and/or reverse-circulation via the axial flowbore is allowed; and transitioning the wellbore servicing apparatus from the first mode to a second mode, wherein, when the wellbore servicing apparatus is in the second mode, reverse-circulation via the axial flowbore is restricted.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru-R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

We claim:

1. A wellbore servicing apparatus comprising:

a tubular body at least partially defining an axial flowbore;

a first valve assembly, positioned within the tubular body, wherein, when activated, the first valve assembly will prevent fluid communication through the axial flowbore in a first direction and allow fluid communication through the axial flowbore in a second direction, and, when deactivated, the first valve assembly will allow fluid communication through the axial flowbore in the first direction and the second direction;

a first sliding sleeve slidable within the tubular body and transitionable from a first position to a second position, wherein, when the first sliding sleeve is in the first position, the first valve assembly is in the activated mode, and, when the first sliding sleeve is in the second position, the first valve assembly is retained in the deactivated mode;

a second valve assembly, positioned within the tubular body downhole from the first valve assembly, wherein, when activated, the second valve assembly will prevent fluid communication through the axial flowbore in the first direction and allow fluid communication through the axial flowbore in the second direction, and, when deactivated, the second valve assembly will allow fluid communication through the axial flowbore in the first direction and the second direction; and a second sliding sleeve slidable within the tubular body and transitionable from a first position to a second position, wherein, when the second sliding sleeve is in the first position, the second valve assembly is retained in the deactivated mode, and, when the second sliding sleeve is in the second position downhole from the first position, the second valve assembly is in the activated mode;

wherein when the first sliding sleeve is in the second position and the second sliding sleeve is in the first position, forward-circulation and reverse-circulation through the axial flowbore will be allowed; and wherein, when the first sliding sleeve is in the second position and the second sliding sleeve is in the second position, forward-circulation and reverse-circulation through the axial flowbore will be prevented.

2. The wellbore servicing apparatus of claim 1, wherein the wellbore servicing apparatus is incorporated within a work string.

3. The wellbore servicing apparatus of claim 1, wherein, when the first sliding sleeve is in the first position and the second sliding sleeve is in the first position, forward-circulation through the axial flowbore will be allowed and reverse-circulation through the axial flowbore will be prevented.

4. The wellbore servicing apparatus of claim 1, wherein the first sliding sleeve comprises a first seat configured to engage a first ball or a dart, wherein the second sliding sleeve comprises a second seat configured to engage a second ball or a dart, and wherein the first ball or dart is characterized as having a greater diameter than the second ball or dart.

5. The wellbore servicing apparatus of claim 1, wherein the first valve assembly, the second valve assembly, or both comprises at least one flapper valve.

6. The wellbore servicing apparatus of claim 1, further comprising one or more ports, wherein the one or mores ports provide a route of fluid communication between the axial flowbore and an annular space in the wellbore when unobstructed, wherein the ports are obstructed when the second sliding sleeve is in the first position, and wherein the ports are unobstructed when the second sliding sleeve is in the second position.

7. A wellbore servicing apparatus comprising an axial flowbore, the wellbore servicing apparatus being transitionable from a first mode to a second mode and transitionable from the second mode to a third mode, wherein, when the wellbore servicing apparatus is in the first mode, reverse-circulation through the axial flowbore is prevented and forward-circulation through the axial flowbore is allowed, when the wellbore servicing apparatus is in the second mode, forward-circulation and reverse-circulation through the axial flowbore is allowed, and when the wellbore servicing apparatus is in the third mode, forward-circulation and reverse-circulation through the axial flowbore are prevented.

8. The wellbore servicing apparatus of claim 7, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the first mode, the first valve assembly is in an activated configuration and the second sliding sleeve retains the second valve assembly in an deactivated configuration.

9. The wellbore servicing apparatus of claim 7, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the second mode, the first sliding sleeve retains the first valve assembly in an deactivated configuration and the second sliding sleeve retains the second valve assembly in an deactivated configuration.

10. The wellbore servicing apparatus of claim 7, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the third mode, the first sliding sleeve retains the first valve assembly in an deactivated configuration and the second valve assembly is in an activated configuration.

11. A wellbore servicing method comprising:

positioning a wellbore servicing apparatus comprising an axial flowbore within a wellbore in a first mode, wherein, when the wellbore servicing apparatus is in the first mode, reverse-circulation through the axial flowbore is prevented and forward-circulation through the axial flowbore is allowed;

transitioning the wellbore servicing apparatus from the first mode to a second mode, wherein, when the wellbore servicing apparatus is in the second mode, forward-circulation and reverse-circulation through the axial flowbore is allowed; and transitioning the wellbore servicing apparatus from the second mode to a third mode, wherein, when the wellbore servicing apparatus is in the third mode, forward-circulation and reverse-circulation through the axial flowbore are prevented.

12. The wellbore servicing method of claim 11, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the first mode, the first valve assembly is in an activated configuration and the second sliding sleeve retains the second valve assembly in an deactivated configuration.

13. The wellbore servicing method of claim 11, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the second mode, the first sliding sleeve retains the first valve assembly in an deactivated configuration and the second sliding sleeve retains the second valve assembly in an deactivated configuration.

14. The wellbore servicing method of claim 13, wherein moving the first sliding sleeve from the first position to the second position comprises circulating a first obturating member via at least a portion of the axial flowbore to engage the first sliding sleeve.

15. The wellbore servicing method of claim 14, wherein moving the second sliding sleeve from the first position to the second position comprises circulating a second obturating member via at least a portion of the axial flowbore to engage the second sliding sleeve.

16. The wellbore servicing method of claim 11, wherein the wellbore servicing apparatus comprises:

a first sliding sleeve operable to transition a first valve assembly from an active state to a deactive state; and a second sliding sleeve operable to transition a second valve assembly from a deactive state to an active state, wherein, when the wellbore servicing apparatus is in the third mode, the first sliding sleeve retains the first valve assembly in an deactivated configuration and the second valve assembly is in an activated configuration.

17. The wellbore servicing method of claim 11, wherein the wellbore servicing apparatus comprises:

a first sliding sleeve operable to transition a first valve assembly from an active state to a deactive state;

a second sliding sleeve operable to transition a second valve assembly from a deactive state to an active state; and one or more ports operable to provide a route of fluid communication between the axial flowbore and an annular space in the wellbore when unobstructed, wherein the ports are obstructed when the second sliding sleeve is in a first position, and wherein the ports are unobstructed when the second sliding sleeve is in a second position.

18. The wellbore servicing method of claim 17, further comprising communicating a fluid from the axial flowbore to the annular space in the wellbore.

19. A wellbore servicing method comprising:

positioning a workstring having incorporated therein a first wellbore servicing apparatus and a second wellbore servicing apparatus and generally defining an axial flowbore within a wellbore, wherein the first wellbore servicing apparatus is incorporated within the workstring uphole relative to the second wellbore servicing apparatus, wherein the first wellbore servicing apparatus and the second wellbore servicing apparatus are each positioned within the wellbore in a first mode, and wherein, when the first wellbore servicing apparatus is in the first mode and the second wellbore servicing apparatus is in the first mode, forward-circulation through the axial flowbore is not prevented by either the first or second wellbore servicing apparatus and reverse-circulation through the axial flowbore is prevented;

transitioning the first wellbore servicing apparatus from the first mode to a second mode, wherein, when the first wellbore servicing apparatus is in the second mode and the second wellbore servicing apparatus is in the first mode, forward-circulation and reverse-circulation through the axial flowbore is not prevented by either the first or second wellbore servicing apparatus; and transitioning the second wellbore servicing apparatus from the first mode to a second mode, wherein, when the first wellbore servicing apparatus is in the second mode and the second wellbore servicing apparatus is in the second mode, forward-circulation and reverse-circulation through the axial flowbore is prevented.

20. The wellbore servicing method of claim 19, wherein the wellbore servicing apparatus further comprises one or more ports operable to provide a route of fluid communication between at least a portion of the axial flowbore and the exterior of the wellbore servicing apparatus when unobstructed, wherein the one or more ports are obstructed when the wellbore servicing apparatus is in the first mode, and wherein the one or more ports are unobstructed when the wellbore servicing apparatus is the second mode.

21. The wellbore servicing method of claim 20, further comprising communicating a fluid from the portion of the axial flowbore to the exterior of the wellbore servicing apparatus via the one or more ports.

22. A wellbore servicing apparatus comprising an axial flowbore, the wellbore servicing apparatus being transitionable from a first mode to a second mode and transitionable from the second mode to a third mode, wherein, when the wellbore servicing apparatus is in the first mode, reverse-circulation through the axial flowbore is prevented, when the wellbore servicing apparatus is in the second mode, forward-circulation and reverse-circulation through the axial flowbore is allowed, and when the wellbore servicing apparatus is in the third mode, forward-circulation and reverse-circulation through the axial flowbore is prevented.

23. The wellbore servicing apparatus of claim 22, further comprising one or more ports, wherein, when the wellbore servicing apparatus is in the third mode, the one or more ports are configured to provide a route of fluid communication between at least a portion of the axial flowbore and an exterior of the wellbore servicing apparatus.

* * * * *

UNITED STATES PATENT AND TRADEMARK OFFICE

CERTIFICATE OF CORRECTION

PATENT NO. : 8,733,449 B2
APPLICATION NO. : 13/087810
DATED : May 27, 2014
INVENTOR(S) : Muhammad Asif Ehtesham et al.

It is certified that error appears in the above-identified patent and that said Letters Patent is hereby corrected as shown below:

Title page, Item 73, replace Assignee "Hilliburton Energy Services, Inc." with --Halliburton Energy Services, Inc.--.

Signed and Sealed this
Fifth Day of August, 2014

Michelle K. Lee

Michelle K. Lee
*Deputy Director of the United States Patent and Trademark Office*